US005374789A

United States Patent [19]

Bernstorf

[11] Patent Number: 5,374,789

[45] **Date of Patent: * Dec. 20, 1994**

[54] ELECTRICAL ASSEMBLY WITH SEALING SYSTEM FOR END FITTING AND WEATHERSHED HOUSING

[75] Inventor: Robert A. Bernstorf, Wadsworth, Ohio

[73] Assignee: Hubbell Incorporated, Orange, Conn.

[ * ] Notice: The portion of the term of this patent subsequent to Oct. 27, 2009 has been disclaimed.

[21] Appl. No.: 707,892

[22] Filed: May 30, 1991

[51] Int. Cl.[5] ..... H01B 17/38

[52] U.S. Cl. ..... 174/188; 174/169; 174/176; 174/179; 174/192

[58] Field of Search ..... 174/188, 186, 142, 152 R, 174/169, 176, 192, 140 S, 177, 178, 179

[56] References Cited

U.S. PATENT DOCUMENTS

| | | | |
|---|---|---|---|
| 974,177 | 11/1910 | Noeggerath | 174/192 |
| 1,246,461 | 11/1917 | Plimpton | 174/192 |
| 1,251,097 | 12/1917 | Peck | 174/192 |
| 1,266,711 | 5/1918 | Plimpton | 174/192 |
| 1,446,523 | 2/1919 | Steinberger | 174/192 |
| 1,617,154 | 7/1919 | Gouverneur | 174/192 |
| 1,738,188 | 6/1927 | Lanyon | 174/192 |
| 3,898,372 | 8/1975 | Kalb | 174/179 |
| 4,057,687 | 11/1977 | Willem | 174/179 |
| 4,296,276 | 10/1981 | Ishihara et al. | 174/140.5 |
| 4,343,966 | 8/1982 | Pargamin | 174/140.5 |
| 4,414,429 | 11/1983 | Kaczerginski et al. | 174/179 |
| 4,427,843 | 1/1984 | Ishihara et al. | 174/140 S |
| 4,435,615 | 3/1984 | Kaczerginski et al. | 174/189 |
| 4,604,498 | 8/1986 | Kuhl | 174/140 S |
| 4,905,118 | 2/1990 | Sakich | 174/178 X |

FOREIGN PATENT DOCUMENTS

| | | | |
|---|---|---|---|
| 540916 | 7/1923 | France | 174/167 |
| 753759 | 10/1933 | France | 174/192 |
| 2424613 | 4/1978 | France . | |
| 2587827 | 3/1987 | France | 174/179 |
| 456051 | 1/1928 | Germany . | |
| 1931550 | 12/1970 | Germany . | |
| 2611504 | 9/1977 | Germany . | |
| 169239 | 9/1921 | United Kingdom . | |
| 398769 | 9/1933 | United Kingdom | 174/192 |
| 873356 | 7/1961 | United Kingdom | 174/179 |
| 1126411 | 2/1967 | United Kingdom . | |
| 2063581 | 6/1981 | United Kingdom | 174/179 |

*Primary Examiner*—Leo P. Picard
*Assistant Examiner*—Hyung S. Sough
*Attorney, Agent, or Firm*—Jerry M. Presson; David L. Tarnoff

[57] ABSTRACT

An electrical assembly, such as an insulator or a surge arrester, having an elastomeric weathershed housing, a pair of end fittings, and a pair of sealing systems for coupling and sealing the interfaces between the end fittings and the ends of the weathershed housing. Each of the end fittings has a bore for receiving an end portion of the weathershed housing, and an annular flange extending inwardly from the bore for engaging and compressing the end portion of the weathershed housing inwardly to form a primary annular seal without crimping the end fitting against the weathershed housing. At least one locking ring is positioned between the end portion of the weathershed housing and the inner surface of the bore for forming a secondary annular seal. Additional sealing can also be provided by axially compressing the weathershed housing between the end fittings.

19 Claims, 2 Drawing Sheets

10
14
30
32
34
24
64
72
44
56
20
18
12
62
60
58
55
66
74
22
52
54
26
48
50
16
46

ELECTRICAL ASSEMBLY WITH SEALING SYSTEM FOR END FITTING AND WEATHERSHED HOUSING

FIELD OF THE INVENTION

This invention relates to an electrical assembly, such as an insulator or a surge arrester, having a sealing system for coupling and sealing the interface between an end fitting and an end of an elastomeric weathershed housing. More specifically, the invention relates to an end fitting having a bore for receiving a portion of an elastomeric weathershed housing, and an inwardly extending flange for applying a radially inwardly directed force on the end of the weathershed housing to form a primary annular seal by compressing the weathershed housing inwardly without crimping the end fitting against the weathershed housing.

BACKGROUND OF THE INVENTION

Electrical assemblies, such as insulators and surge arresters, are typically enclosed within a weathershed housing for insulating and protecting the internal electrical components or core members from the outside environment. Insulators are extensively used to support the electrical conductors of electric power lines. Surge arresters, on the other hand, are commonly connected across electrical equipment to shunt over-voltage surges, such as lightning strikes. A problem common to both insulators and arresters is preventing water ingress at the interface between the end fittings and the ends of the weathershed housings. Specifically, water penetrates between the end fittings and the ends of the weathershed housing, thereby initiating electrical and mechanical destruction of the electrical assembly.

While many attempts have been made to overcome this problem, numerous disadvantages are present in these prior electrical assemblies. For example, many of the prior electrical assemblies have end fittings with an integral end collar which is crimped about the end portion of the weathershed housing. These types of end fittings often do not provide an effective seal, since after a certain number of temperature cycles, gaps appear. Other prior electrical assemblies have their weathershed housings axially compressed between the end fittings. However, these types of seals are vulnerable to breakdown because the electrical potential migrates over the atmospherically soiled weathershed housing, thereby causing the elastomeric housing to erode at its interfaces with the end fittings.

Examples of these prior electrical assemblies are disclosed in the following U.S. Patents: U.S. Pat. No. 974,177 to Noeggerath; U.S. Pat. No. 1,246,461 to Plimpton; U.S. Pat. No. 1,251,097 to Peck; U.S. Pat. No. 1,266,711 to Plimpton; U.S. Pat. No. 1,446,523 to Steinberger; U.S. Pat. No. 1,617,154 to Gouverneur; U.S. Pat. No. 1,738,188 to Lanyon; U.S. Pat. No. 3,898,372 to Kalb; U.S. Pat. No. 4,057,687 to Willem; U.S. Pat. No. 4,296,276 to Ishihara; U.S. Pat. No. 4,343,966 to Pargamin; U.S. Pat. No. 4,414,429 to Kaczerginski; U.S. Pat. No. 4,427,843 to Ishihara et al; U.S. Pat. No. 4,435,615 to Kaczerginski et al; and U.S. Pat. No. 4,604,498 to Kuhl.

Further examples of these prior electrical assemblies are disclosed in United Kingdom Patent 169,239, issued on Sep. 19, 1921; German Patent 456,051, issued on Feb. 13, 1928; German Patent 1,931,550, issued on Dec. 23, 1970; German Patent 2,611,504, issued on Sep. 29, 1977; and French Patent 2,424,613, issued on Dec. 28, 1979.

In view of the above, it is apparent that there exists a need to provide electrical assemblies with a sealing system for coupling and sealing the end fittings and the ends of the weathershed housing together in a weathertight manner. This invention addresses this need in the art along with other needs which will become apparent to those skilled in the art once given this disclosure.

SUMMARY OF THE INVENTION

Accordingly, a primary object of the invention is to provide an electrical assembly which utilizes a sealing system for providing a greatly improved weathertight seal between the metallic end fitting and the elastomeric weathershed housing.

Another object of the invention is to provide an electrical assembly utilizing an end fitting with an inwardly extending annular flange which engages and compresses an end portion of an elastomeric weathershed housing for sealing the interface between the annular flange of the end fitting and the end portion of the weathershed housing without moving the annular flange inwardly by crimping.

Another object of the invention is to provide an electrical assembly which utilizes a sealing system having a primary seal formed by an annular flange compressing an end portion of the elastomeric weathershed housing inwardly and a secondary seal formed by at least one locking ring positioned between the end of the weathershed housing and the end fitting.

Another object of the invention is to provide an electrical assembly which is relatively inexpensive and simple to manufacture and assemble.

A further object of the invention is to provide an electrical assembly utilizing an elastomeric weathershed housing which is forgiving of dimensional variations in its associated parts, thereby reducing the need for expensive close tolerances to provide an effective seal at the end fittings.

The foregoing objects are basically attained by an electrical assembly, the combination comprising: a core member having a first end and a second end; a weathershed housing formed of an elastomeric material, and having a first end, a second end, and an axially extending bore for receiving the core member therein, the first end of the weathershed housing having a first end portion with a predetermined outer cross-sectional width and the second end of the weathershed housing having a second end portion with a predetermined outer cross-sectional width; a first end fitting fixedly coupled to the first end of the core member; and a first sealing system, coupled to the first end fitting, for sealing between the first end fitting and the first end of the weathershed housing, the first sealing system including a first bore with an open end for receiving the first end of the weathershed housing therein, and an inwardly extending annular flange with a predetermined inner cross-sectional width which is smaller than the outer cross-sectional width of the first end portion of the weathershed housing for engaging and compressing the first end portion of the weathershed housing inwardly to form a primary annular seal therebetween without moving the annular flange inwardly.

The foregoing objects are also attained by an electrical assembly, the combination comprising: a core member having a first end, a second end and an outer surface with a predetermined cross-sectional width; a weathershed housing formed of an elastomeric material, and having a first end, a second end and an axially extending bore for receiving the core member therein, the first end of the weathershed housing having a first end portion with a predetermined outer cross-sectional width, and the second end of the weathershed housing having a second end portion with a predetermined outer cross-sectional width; a first end fitting fixedly coupled to the first end of the core member, and having an axially extending bore for receiving the first end of the core member therein, a counterbore for receiving the first end of the weathershed housing therein, and an inwardly extending annular flange with a predetermined inner cross-sectional width smaller than the outer cross-sectional width of the first end portion of the weathershed housing for engaging and compressing the first end portion of the weathershed housing inwardly to form a seal therebetween without moving the annular flange inwardly by crimping; a second end fitting fixedly coupled to the second end of the core member to axially compress the weathershed housing between the first and second end fittings for creating a seal at each of the first and second ends of the weathershed housing, and having an axially extending bore for receiving the second end of the core member therein, a counterbore for receiving the second end of the weathershed housing therein, and an inwardly extending annular flange with a predetermined inner cross-sectional width smaller than the outer cross-sectional width of the second end portion of the weathershed housing for engaging and compressing the second end portion of the weathershed housing inwardly to form a seal therebetween without moving the annular flange of the second end fitting inwardly.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form a part of this original disclosure.

DETAILED DESCRIPTION OF THE INVENTION

Figure 1:
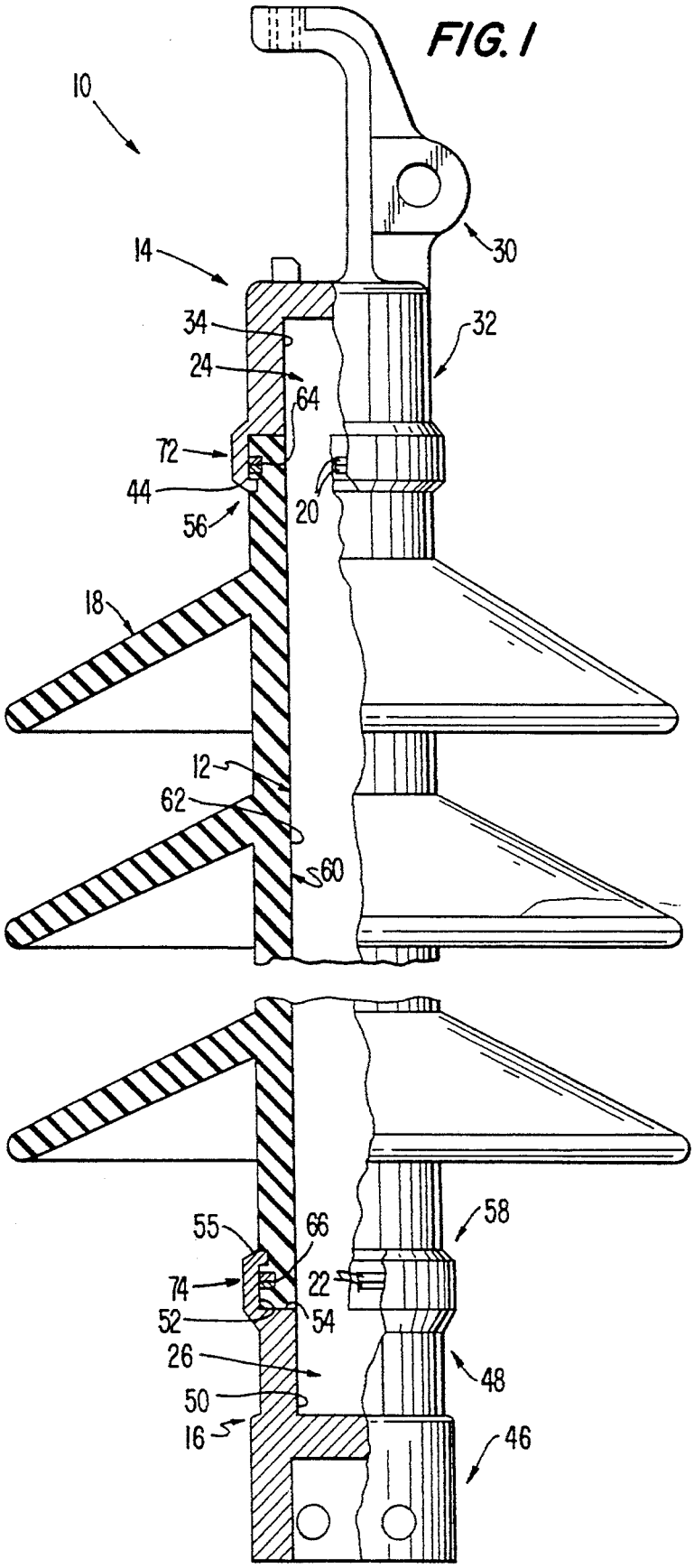
FIG. 1 is a side elevational view in partial section of an electrical assembly in the form of an electrical insulator in accordance with the present invention.

Initially referring to FIG. 1, an electrical assembly 10 according to the present invention is illustrated in the form of an insulator. Electrical assembly 10 includes an insulating core member 12, a first end fitting or connector 14 coupled to the upper end of core member 12, a second end fitting or connector 16 coupled to the lower end of core member 12, an elastomeric weathershed housing 18 overlying and enclosing the portion of core member 12 extending between end fittings 14 and 16, a pair of upper locking rings 20 for coupling and sealing the upper end of weathershed housing 18 to end fitting 14, and a pair of lower locking rings 22 for coupling and sealing the lower end of weathershed housing 18 to end fitting 16.

Core member 12 is illustrated as an elongated cylindrical insulating rod, which is preferably composed of fiberglass reinforced epoxy, vinylester or polyester resin. Core member 12 also can be formed from other electrical components, such as varistors, resistors, capacitors, or any combination thereof. Core member 12, as seen in FIG. 1, has a substantially uniform outer diameter with its upper and lower ends 24 and 26 fixedly coupled to end fittings 14 and 16 in a conventional manner, such as crimping.

First end fitting 14 has a first portion 30 for mechanically and electrically coupling the upper end of electrical assembly 10 to a power line or other support member, and a second portion 32 for coupling and sealing end fitting 14 to core member 12 and weathershed housing 18. Preferably, first and second portions 30 and 32 are formed as a one-piece, unitary, integral member made of a suitable metallic material such as galvanized iron.

First portion 30 of end fitting 14 is a conventional metallic connector used by prior end fittings, and therefore will not be discussed in detail herein. First portion 30 can be formed as any type of connector to accommodate the particular arrangement with which it will be used.

Figure 2:
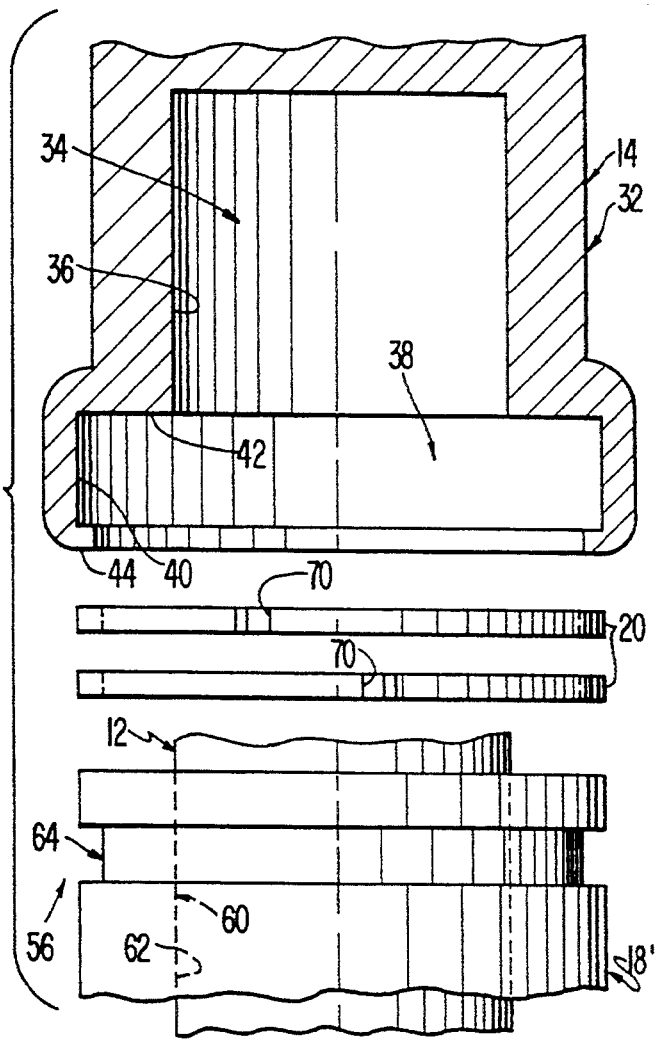
FIG. 2 is an enlarged, exploded, side elevational view in partial section of the upper end of the electrical assembly illustrated in FIG. 1.
Figure 3:
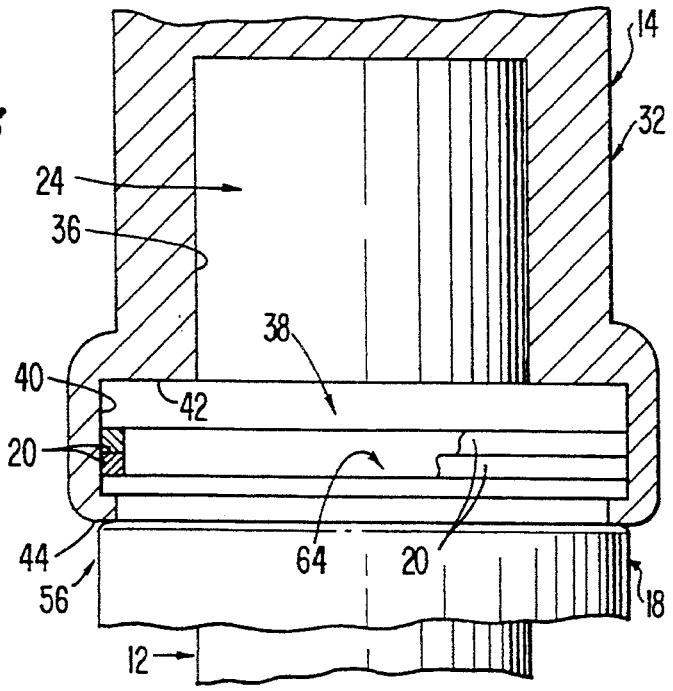
FIG. 3 is an enlarged, side elevational view in partial longitudinal cross section of the upper end of the electrical assembly illustrated in FIGS. 1 and 2.

As seen in FIGS. 2 and 3, second end portion 32 includes a blind bore 34 with a substantially cylindrical inner surface 36 for receiving upper end 24 of core member 12 therein, a counterbore 38 with a substantially cylindrical inner surface 40 for receiving a portion of weathershed housing 18 therein and concentric with bore 34, and an annular shoulder 42 extending between inner surface 36 of bore 34 and inner surface 40 of counterbore 38. Accordingly, counterbore 38 and blind bore 34 form a pair of concentric bores with counterbore 38 being a first bore and blind bore 34 being a second bore. Preferably, end fitting 14 is fixedly coupled to core member 12 by crimping only the portion of end fitting 14 which extends along bore 34.

Second end portion 32 also has an annular flange 44 extending inwardly from the free open end of second portion 32 and substantially perpendicular to inner surface 40 of counterbore 38. Annular flange 44 is substantially rigid and has a predetermined and preformed inner cross-sectional width or diameter which is slightly smaller than the predetermined inner cross-sectional width or diameter of cylindrical inner surface 40 of counterbore 38. Annular flange 44 engages and compresses an upper end portion of weathershed housing 18 for forming an annular seal at the interface of weathershed housing 18 and annular flange 44.

As seen in FIG. 1, second end fitting 16 includes a first portion 46 for mechanically and electrically coupling end fitting 16 to a conventional support member, and a second portion 48 for coupling and sealing end fitting 16 to core member 12 and weathershed housing 18. Preferably, first and second portions 46 and 48 are formed as a one-piece, unitary, integral member made of a suitable metallic material, such as aluminum. First portion 46 is a conventional connector used by prior metallic end fittings, and thus will not be discussed in detail herein.

Second portion 48 is substantially identical to second portion 32 of first end fitting 14, except that second portion 48 is inverted. Second portion 48 includes a cylindrical bore 50 for receiving lower end 26 of core member 12 therein, a counterbore 52 for receiving a portion of weathershed housing 18 therein, an annular shoulder 54 extending between bore 50 and counterbore 52, and an annular, rigid and preformed flange 55 extending inwardly from the free open end of second portion 48 and substantially perpendicular to the inner surface of counterbore 52.

As seen in FIG. 1, weathershed housing 18 has a first or upper end portion 56 and a second or lower end portion 58 with an axially extending through bore 60 extending between upper end portion 56 and lower end portion 58. Preferably, weathershed housing 18 is composed of a polymeric, elastomeric material having sufficient resiliency to be expanded radially outwardly upon insertion of core member 12 into axially extending bore 60 and to be compressed axially and radially inwardly by end fittings 14 and 16 as discussed below.

Bore 60 preferably has a substantially uniform cylindrical inner surface 62 with an internal diameter, or cross-sectional width, which is smaller than or equal to the diameter, or cross-sectional width, of core member 12 when in its unstressed state. Bore 60 or core member 12 can be coated with a viscous insulating material, such as silicone grease, to prevent the ingress of contaminants along the interface of core member 12 and bore 60 of weathershed housing 18. Alternatively, bore 60 can have a series of annular grooves filled with a viscous insulating material as disclosed in U.S. Pat. No. 3,898,372 to Kalb, which is hereby incorporated herein by reference.

Weathershed housing 18, for short electrical assemblies, can be made of a single, unitary elastomeric housing or, for long electrical assemblies, can be made of two or more elastomeric weathershed sections with adjacent ends of the weathershed sections being coupled together in a conventional manner.

As seen in FIGS. 2 and 3, upper end portion 56 of weathershed housing 18 has an outwardly opening annular recess or groove 64 with a rectangular cross section for receiving upper locking rings 20 therein. Preferably, the depth and width of recess 64 are slightly larger than the depth and combined width of locking rings 20 prior to axial compression of the housing. Upon axially compressing weathershed housing 18, the recess 64 will decrease in depth and width to engage and compress against locking rings 20 to form a seal therebetween. Also, recess 64 is spaced axially from the free end of weathershed housing 18 to be positioned between annular flange 44 and shoulder 42, as seen in FIG. 3.

Counterbore 38 of end fitting 14 receives upper end portion 56 therein for sealing the interface between weathershed housing 18 and end fitting 14 as discussed below in more detail. Preferably, the maximum outer diameter of upper end portion 56 of weathershed housing 18 when overlying core member 12 is substantially equal to or greater than the inner diameter or cross-sectional width of inner surface 40 of counterbore 38.

Annular flange 44, on the other hand, has a predetermined inner cross-sectional width which is smaller than the predetermined cross-sectional width or diameter of end portion 56 of weathershed housing 18. Thus, a primary annular seal is formed between end fitting 14 and weathershed housing 18 due to annular flange 44 engaging and compressing the elastomeric material of weathershed housing 18 inwardly. No distortion of annular flange 44 occurs since annular flange 44 is not moved or forced inwardly against weathershed housing 18 by crimping or other means. Accordingly, a more effective seal is formed between annular flange 44 and weathershed housing 18 than in prior electrical assemblies having their end fittings crimped or otherwise distorted against the ends of the weathershed housing.

As seen in FIG. 1, second or lower end portion 58 of weathershed housing 18 has an outwardly opening annular recess or groove 66 for receiving lower locking rings 22 therein. Counterbore 52 of second end fitting 16 receives lower end portion 58 therein for sealing the interface between weathershed housing 18 and lower end fitting 16 in substantially the same manner as the upper end of electrical assembly 10. Accordingly, the lower end portion 58 of weathershed housing 18 will not be discussed or illustrated in detail herein.

Upper and lower locking rings 20 and 22 are preferably conventional resilient split-snap rings made of a resilient metallic material such as stainless steel, or any other resilient material. Locking rings 20 and 22 preferably are rectangular in cross section and have diameters which are substantially equal to, or slightly larger than the inner diameter of inner surface 40 of counterbore 38. Each of the locking rings 20 and 22 has a gap 70 permitting them to be compressed below the inner diameter of annular flanges 44 and 55 so that they can be inserted into counterbores 38 and 52, respectively and then expanded into a sealing engagement therewith, while also being in sealing engagement with the surfaces defining recesses 64 and 66.

While two locking rings are illustrated, it should be apparent that only one or more than two locking rings can be used in each of the recesses 64 and 66. If more than one locking ring is used, then the gaps 70 should be staggered to avoid a continuous path therebetween as seen in FIG. 2.

Locking rings 20 and 22 thus form a secondary annular seal between the upper and lower end portions 56 and 58 of weathershed housing 18 and first and second end fittings 14 and 16, respectively. Also, locking rings 20 and 22 mechanically couple the ends of weathershed housing 18 to end fittings 14 and 16 to prevent shifting of the weathershed housing 18 away from end fittings 14 and 16.

Additional sealing is provided between the .interface of weathershed housing 18 and each of the end fittings 14 and 16 by axially compressing weathershed housing 18 between end fittings 14 and 16. In particular, by axially compressing weathershed housing 18, the upper end portion 56 will press against annular shoulder 42 and expand outwardly against inner surface 40 of counterbore 38 for providing additional sealing between the interface of end fitting 14 and upper end portion 56 of weathershed housing 18. Similarly, lower end portion 58 of weathershed housing 18 is pressed against annular shoulder 54 and expanded outwardly against the inner surface of counterbore 52, Preferably, weathershed housing 18 is compressed axially about 5% of its uncompressed length when fully assembled as seen in FIG. 1.

Accordingly, counterbore 38, shoulder 42, annular flange 44 and locking rings 20 of first end fitting 14 together with the upper end portion 56 of weathershed housing 18 form a first sealing system 72 for coupling and sealing the interface between end fitting 14 and weathershed housing 18. Counterbore 52, shoulder 54, annular flange 55 and locking rings 22 of second end fitting 16 together with the lower end portion 58 of weathershed housing 18 form a second sealing system 74 for coupling and sealing the interface between end fitting 16 and weathershed housing 18.

If further sealing is desired or needed, the interfaces between the end fittings 14 and 16 and weathershed housing 18 can be filled with a conventional sealant, such as epoxy resins or silicone rubber.

Assembly of Electrical Assembly 10

Preferably, electrical assembly 10, illustrated in FIGS. 1–3, is assembled by first expanding upper and lower locking rings 20 and 22, and then inserting them over the upper and lower end portions 56 and 58 of weathershed housing 18 until they are positioned around recesses 64 and 66. When upper and lower locking rings 20 and 22 are released, they contract or snap into recesses 64 and 66. Next, lower end fitting 16 is placed on and crimped or swaged onto core member 12 for fixedly coupling end fitting 16 to core member 12. Then core member 12 is inserted into bore 60 of weathershed housing 18 to expand, or dilate, weathershed housing 18 radially outwardly, thereby providing an interference fit between the entire length of core member 12 and inner surface 62 of weathershed housing 18. The outward radial expansion of weathershed housing 18 by core member 12 produces the desired diameters of the upper and lower end portions 56 and 58 of weathershed housing 18 for sealing with end fittings 14 and 16.

The lower end portion 58 of weathershed housing 18 along with locking rings 22 are squeezed or compressed radially inwardly, then lower end portion 58 and locking rings 22 are moved past annular flange 55 where they expand outwardly into contact with counterbore 52 as seen in FIG. 1.

Now, weathershed housing 18 is over-compressed axially on core member 12 towards lower end fitting 16, and held in axial compression. Upper end fitting 14 is then placed on and crimped or swaged onto core member 12 for fixedly coupling end fitting 14 to the core member. Then, weathershed housing 18 is released to partially expand axially on core member 12, until contacting upper end fitting 14.

Finally, the upper end portion 56 of weathershed housing 18 is squeezed or compressed inwardly along with upper locking rings 20, then upper end portion 56 and rings 20 are moved past annular flange 44, and then expanded outwardly into contact with counterbore 38 as seen in FIG. 3. In this position, the axial extent of housing 18 is still compressed by about 5%.

Accordingly, electrical assembly 10 in its assembled state has its interfaces between weathershed housing 18 and end fittings 14 and 16 sealed in three ways as seen in FIGS. 1 and 3. First, annular flanges 44 and 55 of end fittings 14 and 16 engage and compress the upper and lower end portions 56 and 58 of weathershed housing 18, respectively, to form a primary annular seal therebetween. Second, locking rings 20 and 22 engage the inner surfaces of the counterbores 38 and 52 of the end fittings 14 and 16 and recesses 64 and 66 of the weathershed housing 18 to form a secondary seal. Third, the axial compression of weathershed housing 18 causes upper and lower end portions 56 and 58 to abut against annular shoulders 42 and 54, and to expand outwardly against the inner surfaces of counterbores 38 and 52, respectively, to add an additional seal.

While only one embodiment has been chosen to illustrate the invention, it will be understood by those skilled in the art that various changes and modifications can be made herein without departing from the scope of the invention as defined in the appended claims.

What is claimed is:

1. An electrical assembly, the combination comprising:

a core member having a first end and a second end;

a weathershed housing formed of an elastomeric material, and having a first end, a second end, and an axially extending bore for receiving said core member therein, said first end of said weathershed housing having a first end portion with a predetermined outer cross-sectional width and said second end of said weathershed housing having a second end portion with a predetermined outer cross-sectional width;

a first end fitting fixedly coupled to said first end of said core member; and first means, coupled to said first end fitting, for coupling and sealing said first end fitting to said first end of said weathershed housing, said first means including a first bore with an open end for receiving said first end of said weathershed housing therein, and an inwardly extending undistorted annular flange with a predetermined and preformed inner cross-sectional width which is smaller than said outer cross-sectional width of said first end portion of said weathershed housing for engaging and compressing said first end portion of said weathershed housing inwardly to form a primary annular seal therebetween without moving said annular flange inwardly by distortion.

2. An electrical assembly according to claim 1, wherein said first end portion of said weathershed housing has an annular groove, and said first means further includes at least one locking ring received in said annular groove and having a diameter larger than said inner cross-sectional width of said annular flange of said first end fitting for creating a secondary annular seal between said first end fitting and said weathershed housing.

3. An electrical assembly according to claim 2, wherein said annular groove has two of said locking rings received therein.

4. An electrical assembly according to claim wherein said locking rings are split-snap rings.

5. An electrical assembly according to claim 1, wherein said first bore of said first means is substantially cylindrical, and said first end of said weathershed housing is substantially cylindrical.

6. An electrical assembly according to claim 5, wherein said first means includes a second bore concentrically positioned inwardly of said first bore.

7. An electrical assembly according to claim 6, wherein said core member is an elongated insulating rod with its first end fixedly coupled in said second bore.

8. An electrical assembly according to claim 1, further comprising a second end fitting fixedly coupled to said second end of said core member.

9. An electrical assembly according to claim wherein said weathershed housing is axially compressed between said first and second end fittings to create an additional annular seal between said first and second end fittings and said first and second ends of said weathershed housing, respectively.

10. An electrical assembly according to claim 8, further comprising second means, coupled to said second end fitting, for sealing between said second end fitting and said second end of said weathershed housing, said second means including a first bore with an open end for receiving said second end of said weathershed housing therein, and an inwardly extending annular flange with a predetermined inner cross-sectional width which is smaller than said outer cross-sectional width of said second end portion of said weathershed housing for engaging and compressing said second end portion of said weathershed housing inwardly to form a primary annular seal therebetween without moving said annular flange inwardly by crimping.

11. An electrical assembly according to claim 10, wherein said second end portion of said weathershed housing has an annular groove, and said second means further includes at least one locking ring received in said annular groove of said second end portion, and having a diameter larger than said inner cross-sectional width of said annular flange of said second end fitting for creating a secondary annular seal between said second end fitting and said weathershed housing.

12. An electrical assembly according to claim 11, wherein said annular groove of said second end portion has two of said locking rings received therein.

13. An electrical assembly according to claim 12, wherein said locking rings are split-snap rings.

14. An electrical assembly, the combination comprising:

a core member having a first end, a second end and an outer surface with a predetermined cross-sectional width;

a weathershed housing formed of an elastomeric material, and having a first end, a second end and an axially extending bore for receiving said core member therein, said first end of said weathershed housing having a first end portion with a predetermined outer cross-sectional width, and said second end of said weathershed housing having a second end portion with a predetermined outer cross-sectional width;

a first end fitting fixedly coupled to said first end of said core member, and having an axially extending bore for receiving said first end of said core member therein, a counterbore for receiving said first end of said weathershed housing therein, and an inwardly extending undistorted, annular flange with a predetermined and preformed inner cross-sectional width smaller than said outer cross-sectional width of said first end portion of said weathershed housing for engaging and compressing said first end portion of said weathershed housing inwardly to couple said first end portion of said weathershed housing to said first end fitting and to form a seal therebetween without moving said annular flange inwardly by crimping; and a second end fitting fixedly coupled to said second end of said core member to axially compress said weathershed housing between said first and second end fittings for creating a seal at each of said first and second ends of said weathershed housing, and having an axially extending bore for receiving said second end of said core member therein, a counterbore for receiving said second end of said weathershed housing therein, and an inwardly extending undistorted annular flange with a predetermined and preformed inner cross-sectional width smaller than said outer cross-sectional width of said second end portion of said weathershed housing for engaging and compressing said second end portion of said weathershed housing inwardly to couple said second end portion of said weathershed housing to said second end fitting and to form a seal therebetween without moving said annular flange of said second end fitting inwardly by crimping.

15. An electrical assembly according to claim 14, wherein each of said first and second end portions has an annular groove with at least one locking ring therein, each of said locking rings having a diameter larger than said inner cross-sectional widths of said annular flanges of said first and second end fittings, respectively.

16. An electrical assembly according to claim 15, wherein said locking rings are split-snap rings.

17. An electrical assembly according to claim 16, wherein each of said split-snap rings engages said counterbores of said first and second end fittings, respectively, for creating a seal therebetween.

18. An electrical assembly according to claim 17, wherein said core member is an elongated insulating rod.

19. An electrical assembly according to claim 18, wherein said annular flanges are unitary and integrally formed with said first and second end fittings, respectively.

* * * * *